US008650863B2

(12) United States Patent
Sobue et al.

(10) Patent No.: US 8,650,863 B2
(45) Date of Patent: Feb. 18, 2014

(54) EXHAUST GAS PURIFICATION SYSTEM FOR AN INTERNAL COMBUSTION ENGINE

(75) Inventors: Yuichi Sobue, Susono (JP); Kohei Yoshida, Gotenba (JP); Hiroshi Otsuki, Susono (JP); Masahide Iida, Susono (JP); Itsuya Kurisaka, Susono (JP); Ko Sugawara, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 12/677,249

(22) PCT Filed: Mar. 31, 2009

(86) PCT No.: PCT/JP2009/056694

§ 371 (c)(1),
(2), (4) Date: Mar. 9, 2010

(87) PCT Pub. No.: WO2010/113278

PCT Pub. Date: Oct. 7, 2010

(65) Prior Publication Data

US 2012/0144807 A1 Jun. 14, 2012

(51) Int. Cl.
*F01N 3/00* (2006.01)

(52) U.S. Cl.
USPC ..... 60/297; 60/286; 60/295; 60/301

(58) Field of Classification Search
USPC ..... 60/286, 295, 297, 301, 303
See application file for complete search history.

(56) References Cited

U.S. PATENT DOCUMENTS

| | | | | |
|---|---|---|---|---|
| 7,000,385 | B2 * | 2/2006 | Miyashita | 60/295 |
| 7,454,900 | B2 * | 11/2008 | Hayashi | 60/295 |
| 7,481,046 | B2 * | 1/2009 | Goralski et al. | 60/295 |
| 7,509,801 | B2 * | 3/2009 | Asanuma | 60/295 |
| 7,669,410 | B2 * | 3/2010 | Nagaoka et al. | 60/286 |
| 7,797,925 | B2 * | 9/2010 | Kawamura et al. | 60/277 |
| 8,104,271 | B2 * | 1/2012 | Yoshida et al. | 60/295 |
| 2004/0123590 | A1 | 7/2004 | Tabata et al. | |

(Continued)

FOREIGN PATENT DOCUMENTS

| | | |
|---|---|---|
| JP | A-11-343836 | 12/1999 |
| JP | A-2000-170525 | 6/2000 |

(Continued)

OTHER PUBLICATIONS

International Search Report issued in PCT/JP2009/056694 filed Mar. 31, 2009 (with translation).

(Continued)

*Primary Examiner* — Binh Q Tran
(74) *Attorney, Agent, or Firm* — Oliff, PLC

(57) ABSTRACT

The present invention is intended to improve a SOx reduction rate which is a ratio of an amount of SOx reduction with respect to an amount of SOx occlusion in SOx poisoning recovery processing. In the present invention, in the SOx poisoning recovery processing in which the SOx occluded in an NOx storage reduction catalyst is reduced by decreasing the air fuel ratio of an exhaust gas flowing into the NOx storage reduction catalyst to a predetermined air fuel ratio in a repeated manner, the length of a period in which the air fuel ratio of an exhaust gas flowing into the NOx storage reduction catalyst is decreased is made longer in a relatively early time during the processing than in a relatively late time during the processing.

1 Claim, 7 Drawing Sheets

(56) References Cited

U.S. PATENT DOCUMENTS

| | | | |
|---|---|---|---|
| 2004/0255574 | A1 | 12/2004 | Tamura |
| 2005/0229589 | A1 | 10/2005 | Murata et al. |
| 2008/0028745 | A1 | 2/2008 | Katoh et al. |

FOREIGN PATENT DOCUMENTS

| | | |
|---|---|---|
| JP | A-2000-274232 | 10/2000 |
| JP | A-2003-286878 | 10/2003 |
| JP | A-2004-204812 | 7/2004 |
| JP | A-2005-9391 | 1/2005 |
| JP | A-2005-113921 | 4/2005 |
| JP | A-2005-188387 | 7/2005 |
| JP | A-2005-291100 | 10/2005 |
| JP | A-2006-242124 | 9/2006 |
| JP | B2-4167871 | 8/2008 |

OTHER PUBLICATIONS

Japanese Office Action issued in Japanese Application No. 2010-510588 Dated Jan. 17, 2012 (with trans).

* cited by examiner

EXHAUST GAS PURIFICATION SYSTEM FOR AN INTERNAL COMBUSTION ENGINE

TECHNICAL FIELD

The present invention relates to an exhaust gas purification system provided with an NOx storage reduction catalyst arranged in an exhaust passage of an internal combustion engine.

BACKGROUND ART

In an exhaust gas purification system provided with an NOx storage reduction catalyst (hereinafter referred to simply as a NOx catalyst) arranged in an exhaust passage of an internal combustion engine, SOx poisoning recovery processing is carried out which serves to reduce the SOx occluded in the NOx catalyst. In the SOx poisoning recovery processing, the air fuel ratio of an exhaust gas flowing into the NOx catalyst (hereinafter referred to as an inflow exhaust gas) is decreased to a predetermined air fuel ratio in a repeated manner. As a result, a reducing agent is supplied to the NOx catalyst and at the same time the temperature of the NOx catalyst rises, so the SOx occluded in the NOx catalyst is reduced.

In Patent Document 1, there is described a technique in which at the time when the air fuel ratio of an inflow exhaust gas is decreased in SOx poisoning recovery processing, the air fuel ratio of the inflow exhaust gas is controlled so that the air fuel ratio of an exhaust gas in an outlet of a NOx catalyst is adjusted to a stoichiometric air fuel ratio.

[Patent Document 1] Japanese patent application laid-open No. 2000-170525

DISCLOSURE OF INVENTION

Problem to be Solved by the Invention

When the SOx poisoning recovery processing is executed, the SOx occluded in the NOx catalyst is reduced. However, part of SOx occluded in an upstream portion of the NOx catalyst, even if once reduced, may be again occluded in a downstream portion of the NOx catalyst.

Here, the air fuel ratio of the inflow exhaust gas is decreased, so a greater amount of reducing agent supplied to the NOx catalyst is first consumed by the reduction of the SOx occluded in the upstream portion of the NOx catalyst. Therefore, even if SOx poisoning recovery processing is performed, a sufficient amount of reducing agent is not supplied to the downstream portion of the NOx catalyst, and hence the part of SOx which has been once reduced but occluded again in the downstream portion of the NOx catalyst, as stated above, may become hard to be reduced again. In such a case, there is a possibility that a sufficient SOx reduction rate (a ratio of the SOx reduction amount to the SOx occlusion amount) may not be able to be ensured.

The present invention has been made in view of the above-mentioned problems, and has for its object to provide a technique which is capable of improving the SOx reduction rate in SOx poisoning recovery processing.

Means for Solving the Problems

The present invention makes the length of a period in which the air fuel ratio of an inflow exhaust gas in the SOx poisoning recovery processing is decreased longer in a relatively early time during the processing than in a relatively late time during the processing.

More specifically, an exhaust gas purification system for an internal combustion engine according to the present invention is characterized by comprising:

an NOx storage reduction catalyst arranged in an exhaust passage of the internal combustion engine; and a SOx poisoning recovery processing execution unit that executes SOx poisoning recovery processing to reduce SOx occluded in said NOx storage reduction catalyst by decreasing the air fuel ratio of an exhaust gas flowing into said NOx storage reduction catalyst up to a predetermined air fuel ratio in a repeated manner;

wherein the length of an air fuel ratio decreasing period that is a period in which the air fuel ratio of the exhaust gas flowing into said NOx storage reduction catalyst in SOx poisoning recovery processing is adjusted to said predetermined air fuel ratio is made longer in a relatively early time during the execution of said processing than in a relatively late time during the execution of said processing.

In the relatively early time during the execution of the SOx poisoning recovery processing, the amount of SOx reduction in an upstream portion of the NOx catalyst is larger as compared with the relatively late time during the execution of said processing. Accordingly, an amount of reducing agent consumed by the reduction of the SOx occluded in the upstream portion of the NOx catalyst is large, and the amount of SOx occluded again in a downstream portion of the NOx catalyst is also large.

According to the present invention, the amount of the reducing agent supplied up to the downstream portion of the NOx catalyst can be made to increase in such a relatively early time during the execution of the SOx poisoning recovery processing. Therefore, the SOx occluded again in the downstream portion of the NOx catalyst can be made to reduce again at a higher rate. Accordingly, the SOx reduction rate in the SOx poisoning recovery processing can be improved.

Here, note that in the present invention, said air fuel ratio decreasing period may be gradually shortened with the passage of time after the start of the execution of SOx poisoning recovery processing, or said air fuel ratio decreasing period may be gradually shortened in accordance with the decreasing amount of SOx occlusion in the NOx catalyst. In addition, during the execution of the SOx poisoning recovery processing, said air fuel ratio decreasing period may be shortened in a stepwise manner.

The present invention may be further provided with a SOx reduction amount distribution estimation unit that estimates a distribution of the amount of SOx reduction in the NOx catalyst at the time of the execution of the SOx poisoning recovery processing. In this case, at the time of the execution of the SOx poisoning recovery processing, the larger the rate of the amount of SOx reduction in the upstream portion of the NOx catalyst, the longer said air fuel ratio decreasing period may be made.

According to this, even in cases where the amount of reducing agent consumed by the reduction of the SOx occluded in the upstream portion of the NOx catalyst is large, and the amount of SOx occluded again in the downstream portion of the NOx catalyst is also large, it is possible to ensure an amount of reducing agent supplied to the downstream portion of the NOx catalyst with a higher probability. Accordingly, the SOx reduction rate in the SOx poisoning recovery processing can be further improved.

The present invention may be further provided with a SOx occlusion amount distribution estimation unit that estimates a distribution of the amount of SOx occlusion in the NOx catalyst. At the time of the execution of the SOx poisoning recovery processing, the more the amount of SOx occlusion in a portion of the NOx catalyst than that in the other portions thereof, the more the amount of SOx reduction becomes. Accordingly, said SOx reduction amount distribution estimation unit may estimate the distribution of the amount of SOx reduction based at least on the distribution of the amount of SOx occlusion estimated by the SOx occlusion amount distribution estimation unit.

The SOx occlusion amount distribution estimation unit may estimate the distribution of the amount of SOx occlusion based at least on the history of the temperature distribution of the NOx catalyst and the history of the flow rate of the exhaust gas flowing into the NOx catalyst.

At the time of the execution of the SOx poisoning recovery processing, the lower the temperature of the downstream portion of the NOx catalyst, the more the amount of SOx occluded again in the downstream portion of the NOx catalyst after having once been reduced in the upstream portion thereof becomes. Accordingly, in the present invention, the lower the temperature of the downstream portion of the NOx catalyst, the longer said air fuel ratio decreasing period may be made. According to this, too, the SOx reduction rate in the SOx poisoning recovery processing can be further improved.

Effect of Invention

The present invention can improve the SOx reduction rate in the SOx poisoning recovery processing.

EXPLANATION OF REFERENCE NUMERALS AND CHARACTERS

Figure 1:
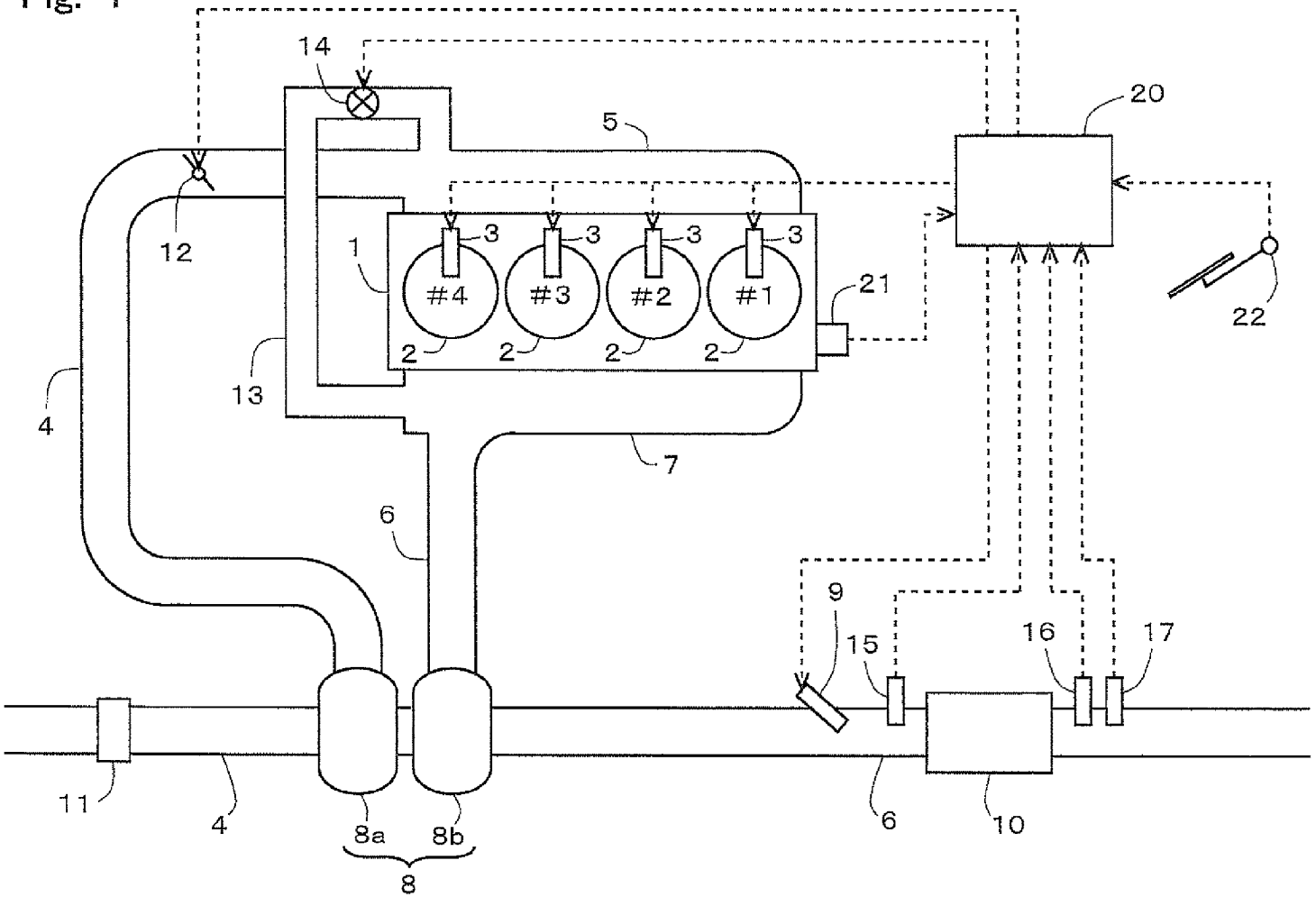
FIG. 1 is a view showing the schematic construction of an internal combustion engine and its intake and exhaust systems according to a first embodiment of the present invention.

1 Internal combustion engine
2 Cylinders
4 Intake passage
6 Exhaust passage
9 Fuel addition valve
10 NOx storage reduction catalyst
15 Upstream temperature sensor
16 Downstream temperature sensor
17 Air fuel ratio sensor
20 ECU

BEST MODE FOR CARRYING OUT THE INVENTION

Hereinafter, specific embodiments of the present invention will be described based on the attached drawings. However, the dimensions, materials, shapes, relative arrangements and so on of component parts described in the embodiments are not intended to limit the technical scope of the present invention to these alone in particular as long as there are no specific statements.

First Embodiment

Reference will be made to a first embodiment of the present invention based on FIGS. 1 through 3.

(Schematic Construction of an Internal Combustion Engine and its Air Intake and Exhaust Systems)

FIG. 1 is a view showing the schematic construction of an internal combustion engine and its intake and exhaust systems according to the first embodiment of the present invention. The internal combustion engine 1 is a diesel engine having four cylinders 2 for driving a vehicle. Each of the cylinders 2 is provided with a fuel injection valve 3 that directly injects fuel into a corresponding cylinder 2.

An intake manifold 5 and an exhaust manifold 7 are connected to the internal combustion engine 1. An intake passage 4 has its one end connected to the intake manifold 5. An exhaust passage 6 has its one end connected to the exhaust manifold 7.

A turbocharger 8 has a compressor 8*a* arranged in the intake passage 4. The turbocharger 8 has a turbine 8*b* arranged in the exhaust passage 6.

An EGR passage 13 has its one end connected to the exhaust manifold 7, and its other end connected to the intake manifold 5. An EGR valve 14 for controlling the amount of an EGR gas is arranged in the EGR passage 13.

An air flow meter 11 is arranged in the intake passage 4 at the upstream side of the compressor 8*a*. A throttle valve 12 is arranged in the intake passage 4 at the downstream side of the compressor 8*a*.

A NOx catalyst 10 is arranged in the exhaust passage 6 at the downstream side of the turbine 8*b*. In addition, a fuel addition valve 9 for adding fuel as a reducing agent to the exhaust gas is arranged in the exhaust passage 6 at the downstream side of the turbine 8*b* and at the same time at the upstream side of the NOx catalyst 10. Here, note that a catalyst having an oxidation function may be arranged in the exhaust passage 6 between the fuel addition valve 9 and the NOx catalyst 10.

An upstream temperature sensor 15 is arranged in the exhaust passage 6 at the downstream side of the fuel addition valve 9 and at the upstream side of the NOx catalyst 10. A downstream temperature sensor 16 and an air fuel ratio sensor 17 are arranged in the exhaust passage 6 at the downstream side of the NOx catalyst 10.

An electronic control unit (ECU) 20 is provided in combination with the internal combustion engine 1. This ECU 20 is a unit that controls the operating state, etc., of the internal combustion engine 1. The air flow meter 11, the upstream temperature sensor 15, the downstream temperature sensor 16, the air fuel ratio sensor 17, a crank position sensor 21, and an accelerator opening sensor 22 are electrically connected to the ECU 20. The crank position sensor 21 detects the crank angle of the internal combustion engine 1. The accelerator opening sensor 22 detects the opening of an accelerator of a vehicle carrying thereon the internal combustion engine 1. The output signals of the individual sensors are inputted into the ECU 20.

The ECU 20 estimates the temperature of the NOx catalyst 10 based on the output values of the respective temperature sensors 15, 16. The ECU 20 derives the engine rotational speed of the internal combustion engine 1 based on the output value of the crank position sensor 21. The ECU 20 also derives the engine load of the internal combustion engine 1 based on the output value of the accelerator opening sensor 22.

In addition, the individual fuel injection valves 3, the throttle valve 12, and the fuel addition valve 9 are electrically connected to the ECU 20. Thus, these parts are controlled by the ECU 20.

(SOx Poisoning Recovery Processing)

In this embodiment, in order to cause the SOx occluded in the NOx catalyst 10 to be reduced, SOx poisoning recovery processing is carried out. Hereinafter, reference will be made to a specific method of the SOx poisoning recovery processing according to this embodiment based on FIG. 2. FIG. 2 is a time chart showing the changes over time of an amount of SOx occlusion Qs in the NOx catalyst 10, an air fuel ratio Rgin of an inflow exhaust gas, and command signals for combustion rich control and fuel addition rich control to be described later, at the time of the execution of SOx poisoning recovery processing.

In this embodiment, when the amount of SOx occlusion Qs in the NOx catalyst 10 becomes equal to or more than a threshold Qs0 for the start of SOx poisoning recovery processing execution, the execution of SOx poisoning recovery processing is started. The SOx poisoning recovery processing according to this embodiment is achieved by means of so-called rich spike control that decreases the air fuel ratio Rgin of an inflow exhaust gas to a target rich air fuel ratio Rgt in a repeated manner. Here, the target rich air fuel ratio Rgt is a rich air fuel ratio which is able to reduce the NOx occluded in the NOx catalyst 10, and is beforehand determined based on experiments, etc. Here, note that the target value at the time of decreasing the air fuel ratio Rgin of the inflow exhaust gas in the rich spike control may be equal to or more than a stoichiometric air fuel ratio as long as the reduction of the NOx occluded in the NOx catalyst 10 is able to be made.

In the following, a period Δtr in which the air fuel ratio Rgin of the inflow exhaust gas is decreased to the target rich air fuel ratio Rgt in the rich spike control is referred to as a rich period Δtr, and a period Δt1 which is between adjacent rich periods and in which the air fuel ratio Rgin of the inflow exhaust gas becomes a lean air fuel ratio is referred to as a lean period Δtl. Here, note that in FIG. 2, the number of rich periods Δtr in the rich spike control is three, but the number thereof is not limited to this. In this embodiment, this rich period Δtr corresponds to an air fuel ratio decreasing period according to the present invention.

Then, in this embodiment, the rich spike control is achieved by using, in combination, the combustion rich control which decreases the air fuel ratio Rgin of the inflow exhaust gas by decreasing the air fuel ratio of the combustion gas in each cylinder 2, and the fuel addition rich control which decreases the air fuel ratio Rgin of the inflow exhaust gas by adding fuel from the fuel addition valve 9. That is, each rich period Δtr is formed by executing the combustion rich control and the fuel addition rich control in succession.

Figure 2:
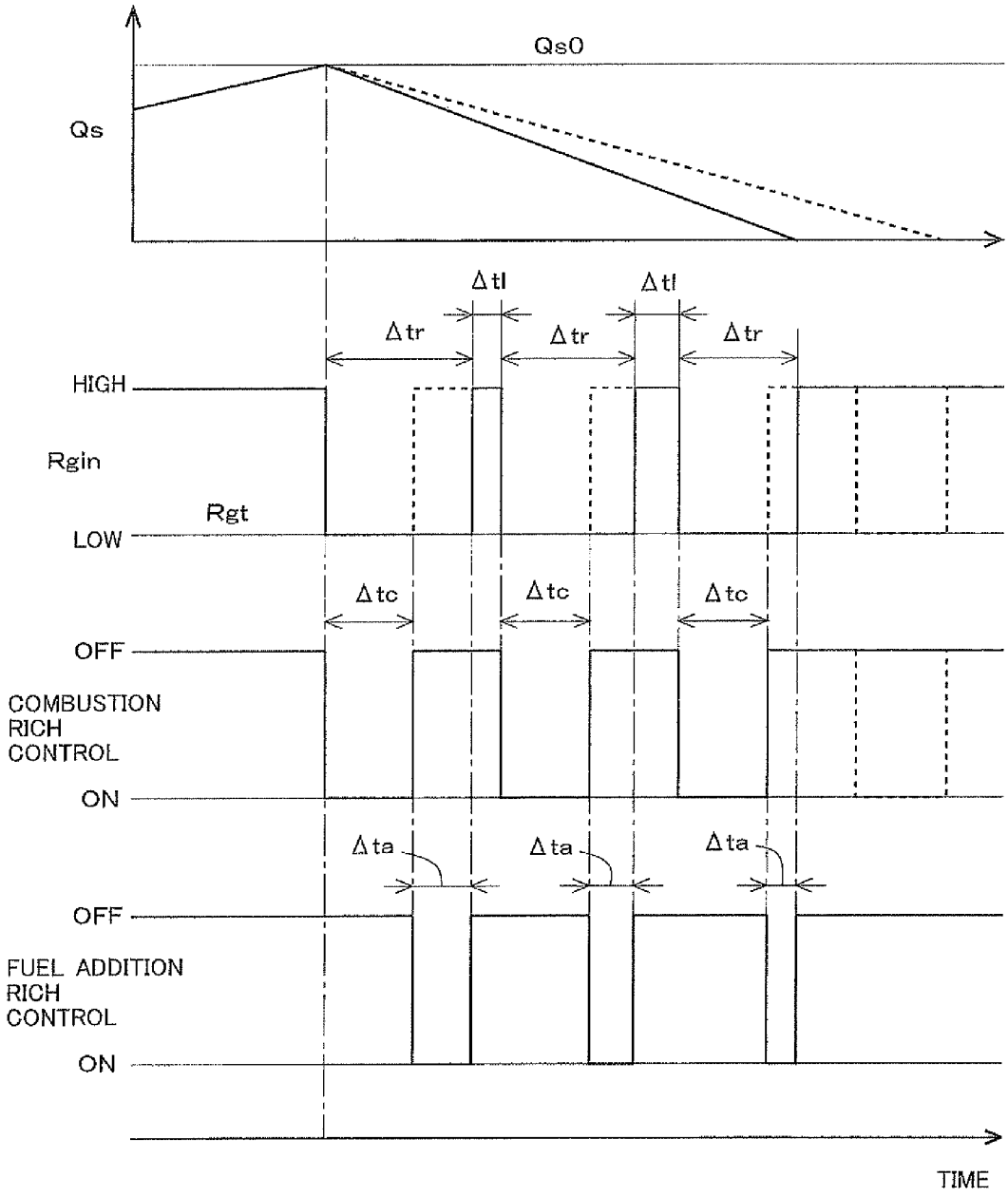
FIG. 2 is a time chart showing the changes over time of an amount of SOx occlusion Qs in a NOx catalyst 10, an air fuel ratio Rgin of an inflow exhaust gas, and command signals for combustion rich control and fuel addition rich control, at the time of the execution of SOx poisoning recovery processing according to the first embodiment.

More specifically, as shown in FIG. 2, the air fuel ratio Rgin of the inflow exhaust gas is decreased to the target rich air fuel ratio Rgt by first executing combustion rich control in a rich period Δtr. Then, the air fuel ratio Rgin of the inflow exhaust gas is maintained to the target rich air fuel ratio Rgt by stopping the combustion rich control and at the same time performing fuel addition rich control after the combustion rich control has been carried out in a predetermined combustion rich period Δtc. The fuel addition rich control is stopped after it has been carried out in a fuel addition rich period Δta, whereby the air fuel ratio Rgin of the inflow exhaust gas becomes a lean air fuel ratio. As a result, the rich period Δtr becomes equal to the combustion rich period Δtc+the fuel addition rich period Δta.

In this manner, by achieving the rich spike control according to the combustion rich control and the fuel addition rich control, it is possible to make the length of each rich period longer as compared with the case in which the rich spike control is achieved by the combustion rich control alone. A broken line in FIG. 2 indicates the changes over time of the amount of SOx occlusion Qs of the NOx catalyst 10 and the air fuel ratio Rgin of the inflow exhaust gas when the rich spike control is achieved by the combustion rich control alone. In this embodiment, the reduction of SOx can be promoted by making each rich period longer according to the above-mentioned method, and so, as shown in this FIG. 2, it becomes possible to cause the SOx poisoning recovery processing to be completed in an earlier period of time.

Here, note that even in cases where rich spike control is achieved by combustion rich control alone, each rich period Δtr can be made longer by increasing each combustion rich period Δtc. However, during the combustion rich period Δtc, the temperature of the exhaust gas discharged from the internal combustion engine 1 rises, whereas the temperature of the NOx catalyst 10 falls because the oxidation reaction in the NOx catalyst 10 is inhibited. Therefore, when the combustion rich period Δtc becomes excessively long, there is the possibility of causing a excessive rise in temperature of the exhaust-gas temperature, or causing an excessive fall in the temperature of the NOx catalyst 10.

In addition, rich spike control is achieved by fuel addition rich control alone, and each rich period Δtr can also be made longer by increasing each fuel addition rich period Δta. However, during the fuel addition rich period Δta, the temperature of the NOx catalyst 10 is caused to rise due to the oxidation reaction of the added fuel in the NOx catalyst 10. Therefore, when the fuel addition rich period Δta becomes excessively long, there is a possibility of causing an excessive rise in the temperature of the NOx catalyst 10.

According to this embodiment, each rich period can be made longer, while suppressing the defects in the case of achieving rich spike control by means of either one of combustion rich control and fuel addition rich control, as stated above.

Further, in this embodiment, as shown in FIG. 2, the length of the rich period Δtr under the execution of rich spike control is made longer at a relatively early time during the execution of such control than at a relatively late time during the execution of such control. That is, the rich period Δtr is made the longest immediately after the start of the execution of rich spike control, and the length thereof is gradually shortened with the passage of time after that. More specifically, the rich period Δtr is gradually shortened by decreasing the fuel addition rich period Δta in each rich period Δtr in a gradual manner.

The amount of SOx occlusion in the upstream portion of the NOx catalyst 10 becomes the largest at the time of the start of the execution of SOx poisoning recovery processing, i.e., at the time of the start of the execution of rich spike control.

Therefore, at a relatively early time during the execution of the rich spike control, the amount of SOx reduction in the upstream portion of the NOx catalyst is larger as compared with a relatively late time during the execution of that processing. Accordingly, the amount of fuel (reducing agent) consumed by the reduction of the SOx occluded in the upstream portion of the NOx catalyst 10 is large, and the amount of SOx occluded again in the downstream portion of the NOx catalyst 10 is also large.

As stated above, by making longer the rich period Δtr at the relatively early time during the execution of the rich spike control, the amount of fuel supplied up to the downstream portion of the NOx catalyst 10 at this time can be made to increase. Therefore, it becomes possible to reduce again the SOx that has been occluded again in the downstream portion of the NOx catalyst 10, at a higher rate.

Accordingly, according to the present invention, the SOx reduction rate in the SOx poisoning recovery processing can be improved. In addition, the amount of fuel used for the SOx poisoning recovery processing can be suppressed as compared with the case where each rich period during the execution of the rich spike control is increased uniformly.

(Flow of SOx Poisoning Recovery Processing)

Next, reference will be made to the flow of the SOx poisoning recovery processing according to this embodiment based on a flow chart shown in FIG. 3. This flow is beforehand stored in the ECU 20, and is repeatedly carried out by the ECU 20 at a predetermined interval. Here, note that in this embodiment, the ECU 20 executing this flow corresponds to a SOx poisoning recovery processing execution unit according to the present invention.

In this flow, first in step S102, the amount of SOx occlusion Qs in the NOx catalyst 10 is estimated. The SOx occlusion amount Qs is estimated based on the histories of an accumulated or integrated quantity of the amounts of fuel injected in the internal combustion engine 1, the history of the flow rate of the inflow exhaust gas, and the history of the temperature of the NOx catalyst 10, after the last SOx poisoning recovery processing is completed, etc.

Subsequently, in step S102, it is determined whether the amount of SOx occlusion Qs in the NOx catalyst 10 estimated in step S101 is equal to or more than the threshold Qs0 for the start of the execution of SOx poisoning recovery processing. The threshold Qs0 is a value that is beforehand determined based on experiments, etc. In step S102, when an affirmative determination is made, processing in the following step S103 is carried out, whereas when a negative determination is made, the execution of this flow is once ended.

In step S103, the length of a fuel addition rich period Δta for forming a part of a first rich period Δtr at the time of the execution of rich spike control is set to Δta1. Here, Δta1 may be a fixed value defined beforehand, or may be a value that is determined based on the temperature of the NOx catalyst 10 at the current point in time, etc.

Then, in step S104, the execution of combustion rich control is started so that the execution of rich spike control should be started. By doing so, an air fuel ratio Rin of the inflow exhaust gas falls to the target rich air fuel ratio Rgt.

Subsequently, in step S105, it is determined whether the combustion rich period Δtc has passed after the execution of combustion rich control is started. When an affirmative determination is made in step S105, processing in the following step S106 is carried out, whereas when a negative determination is made, the execution of this flow is once ended.

In step S106, the execution of the combustion rich control is stopped. Then, subsequently in step S107, the execution of fuel addition rich control is started. Here, in actuality, there exists a response delay until the time the air fuel ratio Rin of the inflow exhaust gas changes after the execution of the combustion rich control and the fuel addition rich control is stopped or started, and the length of such a response delay differs for each control. In steps S106 and S107, in consideration of these response delays, switching is made from the combustion rich control to the fuel addition rich control at such a timing that the air fuel ratio Rin of the inflow exhaust gas can be maintained to be the target rich air fuel ratio Rgt.

Then, in step S108, it is determined whether the fuel addition rich period Δta has passed after the execution of fuel addition rich control is started. When an affirmative determination is made in step S108, processing in the following step S109 is carried out, whereas when a negative determination is made, the processing of step S108 is carried out in a repeated manner.

In step S109, the execution of the fuel addition rich control is stopped.

Subsequently, in step S110, the amount of SOx occlusion Qs in the NOx catalyst 10 at the current point in time is estimated. Here, a decreased amount of SOx occlusion is estimated based on the histories of the flow rate of the inflow exhaust gas and the temperature of the NOx catalyst 10, after the start of the execution of the rich spike control, etc., and the amount of SOx occlusion is calculated by subtracting the decreased amount of SOx occlusion from the amount of SOx occlusion at the time of the start of the execution of the rich spike control.

Thereafter, in step S111, it is determined whether the amount of SOx occlusion Qs in the NOx catalyst 10 estimated in step S110 is equal to or less than a threshold Qs1 for the end of the execution of SOx poisoning recovery processing. The threshold Qs1 is a value that is beforehand defined based on experiments, etc. In step S111, when an affirmative determination is made, the execution of this flow is once ended, whereas when a negative determination is made, processing in step S112 is then carried out.

In step S112, the length of the lean period Δtl until the air fuel ratio Rgin of the inflow exhaust gas is decreased to the target rich air fuel ratio Rgt next is determined. Here, the length of the lean period Δtl is determined based on the length of the last rich period Δtr. That is, in the rich spike control according to this embodiment, the sum of a rich period Δtr and a lean period Δtl successive to each other is constant, so the length of the lean period Δtl is changed according to the length of the rich period Δtr.

Then, in step S113, the length of the fuel addition rich period Δta in the following rich period Δtr is set to Δtan. Here, Δtan is a length of the fuel addition rich period Δta for forming a part of the n-th rich period Δtr in the current rich spike control. For example, if it is the fuel addition rich period Δta in the second rich period Δtr in the current rich spike control, the length of the fuel addition rich period is set to Δta2, and if it is the fuel addition rich period Δta in the third rich period Δtr, the length of the fuel addition rich period is set to Δta3. In addition, Δtan has a value smaller than a length Δta(n−1) of the fuel addition rich period in the (n−1)-th rich period Δtr.

Subsequently, in step S114, it is determined whether the lean period Δtl passed after the execution of the fuel addition rich control is stopped in step S109, i.e., from the end of the last rich period Δtr. In step S114, when an affirmative determination is made, processing in the following step S104 is carried out, whereas when a negative determination is made, the processing of step S114 is carried out in a repeated manner.

According to the above-mentioned flow, a rich period Δtr in the rich spike control is formed of a combustion rich period Δtc and a fuel addition rich period Δta. Then, a rich period Δtr immediately after the start of the execution of the rich spike control is the longest, and thereafter, the length thereof becomes shorter each time a rich period Δtr is formed.

In addition, in the above description, the rich periods are gradually shortened with the passage of time in the execution of rich spike control, but the lengths of the rich periods may be changed step by step. For example, in the execution of rich spike control, the lengths of rich periods are assumed to be changed in two steps, and a rich period in the first half of the period of the execution of that control may be made longer than a rich period in the second half thereof.

Moreover, in the case of achieving rich spike control, auxiliary fuel injection rich control may be carried out in place of fuel addition rich control. In the auxiliary fuel injection rich control, the air fuel ratio Rgin of the inflow exhaust gas is decreased by performing auxiliary fuel injection by means of the fuel injection valves 3 at a timing which is later than main fuel injection and at which auxiliary fuel thus injected is not used for the combustion in each of the cylinders 2. According to the auxiliary fuel injection rich control, fuel can be supplied to the NOx catalyst 10 while ensuring the amount of oxygen in the exhaust gas, as in the fuel addition rich control.

Second Embodiment

Figure 4:
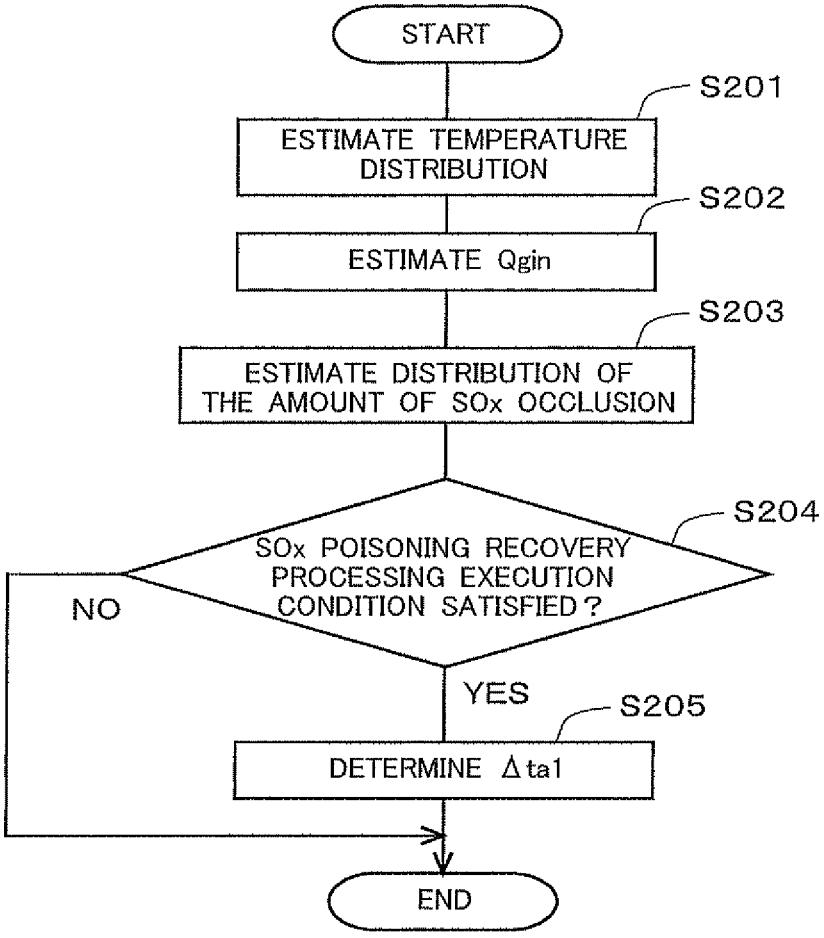
FIG. 4 is a flowchart showing the flow for determining the length of a fuel addition rich period according to a second embodiment.

Reference will be made to a second embodiment of the present invention based on FIG. 4. Here, only differences of the second embodiment from the first embodiment will be explained.

(Determination Method for Rich Period)

In this embodiment, too, SOx poisoning recovery processing is achieved by means of rich spike control, similar to the first embodiment. In addition, a rich period in rich spike control is formed by executing combustion rich control and fuel addition rich control in a sequential manner.

Here, note that when SOx poisoning recovery processing is executed, the more the amount of SOx reduction in the upstream portion of the NOx catalyst 10, the more the amount of fuel consumed for the reduction of SOx in the upstream portion of the NOx catalyst 10 becomes. In addition, the more the amount of SOx reduction in the upstream of the NOx catalyst 10, the more the amount of SOx occluded again in the downstream portion of the NOx catalyst 10 becomes. As a result, the more the amount of SOx reduction in the upstream of the NOx catalyst 10, the more the fuel for fully reducing SOx in the downstream portion of the NOx catalyst 10 is liable to be short.

Accordingly, in this embodiment, the distribution of the amount of SOx reduction in the NOx catalyst 10 at the time of the execution of SOx poisoning recovery processing is estimated. The larger the rate of the amount of SOx reduction in the upstream portion of the NOx catalyst 10, the longer the rich period in rich spike control is made.

By making the rich period longer, the amount of fuel supplied up to the downstream portion of the NOx catalyst 10 can be increased. Therefore, it is possible to suppress the shortage of fuel for reducing SOx in the downstream portion of the NOx catalyst 10. Accordingly, the SOx reduction rate in the SOx poisoning recovery processing can be further improved.

(Estimation Method for the Distribution of the Amount of SOx Reduction)

The more the amount of SOx occlusion in a portion of the NOx catalyst 10 than that in the other portions thereof, the more the amount of SOx reduction becomes. Accordingly, in this embodiment, the distribution of the amount of SOx occlusion in the NOx catalyst 10 is estimated, and the distribution of the amount of SOx reduction is estimated based on the distribution of the amount of SOx occlusion.

In the NOx catalyst 10, the amount of SOx occlusion basically increases in the more upstream portions thereof. However, the distribution of the amount of SOx occlusion changes according to the temperature distribution of the NOx catalyst 10, the flow rate of the inflow exhaust gas, etc. That is, the lower the temperature of the NOx catalyst 10, the more SOx is liable to be occluded. In addition, the more the flow rate of the inflow exhaust gas, the higher the rate of SOx occluded in the downstream portion of the NOx catalyst 10 becomes.

Therefore, in this embodiment, the distribution of the amount of SOx occlusion in the NOx catalyst 10 is estimated based on the histories of the temperature distribution of the NOx catalyst 10 and the flow rate of the inflow exhaust gas. Here, note that the temperature distribution of the NOx catalyst 10 is estimated based on the output values of the upstream and downstream temperature sensors 15, 16. In addition, the flow rate of the inflow exhaust gas is estimated based on the operating state of the internal combustion engine 1.

(Flow for the Determination of Fuel Addition Rich Period)

In this embodiment, the above-mentioned adjustment of the length of a rich period is performed by adjusting the length of a fuel addition rich period in the rich period. Hereinafter, reference will be made to the flow for determining the length of a fuel addition rich period according to this embodiment based on a flow chart shown in FIG. 4. This flow is beforehand stored in the ECU 20, and is repeatedly carried out by the ECU 20 at a predetermined interval.

In this flow, first in step S201, the temperature distribution of the NOx catalyst 10 is estimated.

Then, in step S202, the flow rate Qgin of the inflow exhaust gas is estimated.

Subsequently, in step S203, the distribution of the amount of SOx occlusion in the NOx catalyst 10 is estimated based on the histories of the temperature distribution of the NOx catalyst 10 and the flow rate of the inflow exhaust gas Qgin. Here, note that in this embodiment, the ECU 20 executing the processing of step S203 corresponds to a SOx occlusion amount distribution estimation unit according to the present invention, and also to a SOx reduction amount distribution estimation unit according to the present invention.

Figure 3:
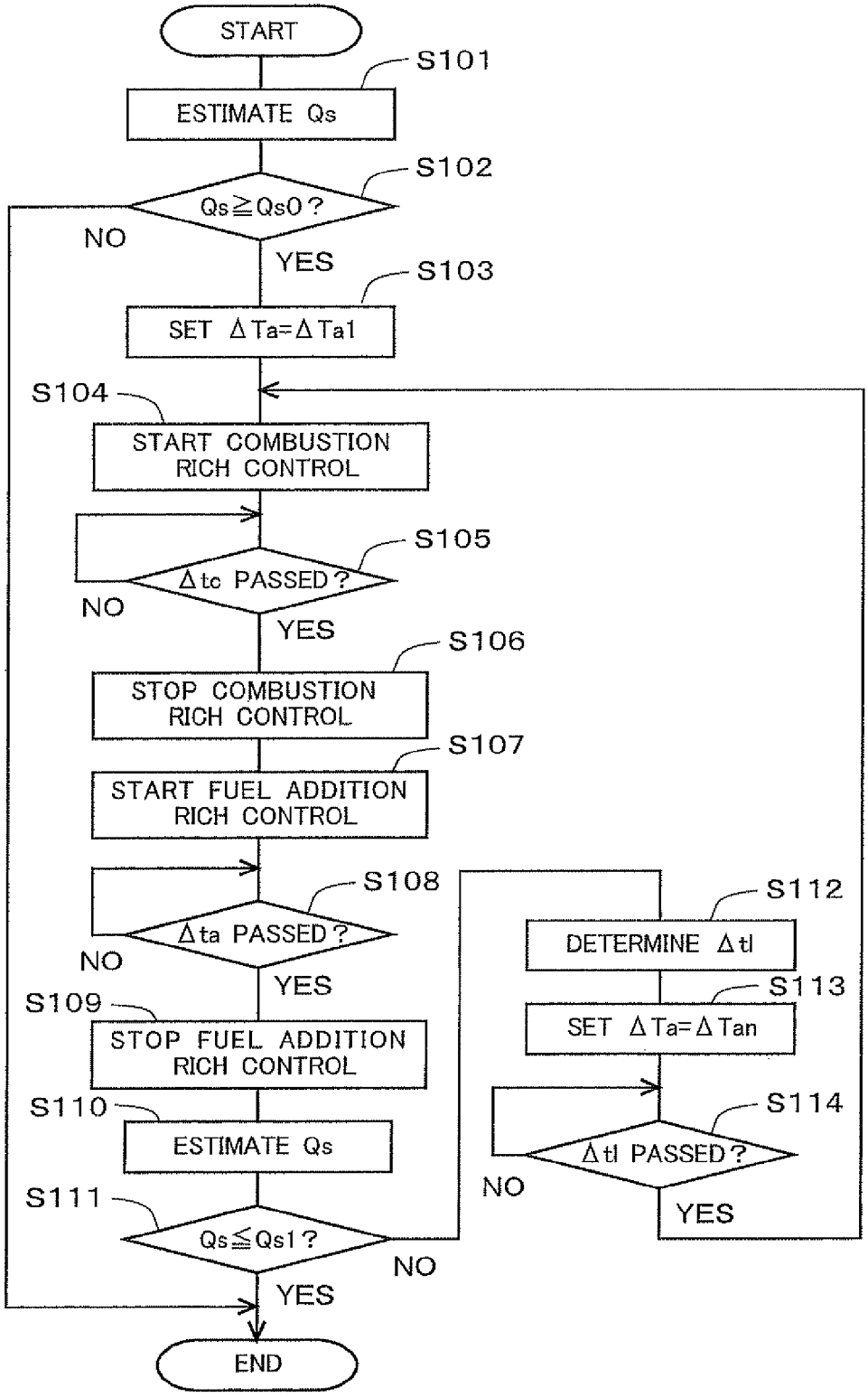
FIG. 3 is a flow chart showing the flow of the SOx poisoning recovery processing according to the first embodiment.

Thereafter, in step S204, it is determined whether the execution condition of SOx poisoning recovery processing has been satisfied, i.e., it is determined, in step S102 in the flow of the SOx poisoning recovery processing shown in FIG. 3, whether an affirmative determination has been made. In step S204, when an affirmative determination has been made, processing in the following step S205 is carried out, whereas when a negative determination has been made, the execution of this flow is once ended.

In step S205, Δta1, which is the length of a fuel addition rich period Δta for forming a part of a first rich period Δtr at the time of the execution of rich spike control, is determined based on the distribution of the amount of SOx occlusion in the NOx catalyst 10. Here, note that the larger the rate of the amount of SOx occlusion in the upstream portion of the NOx catalyst 10, the larger the value of Δta1 is determined to be. The relation between the rate of the amount of SOx occlusion in the upstream portion of the NOx catalyst 10 and Δta1 is beforehand determined based on experiments, etc., and is beforehand stored in the ECU 20.

The value of Δta1 that has been determined in the above-mentioned step S205 is applied to the processing of step S103 in the flow of the SOx poisoning recovery processing shown in FIG. 3. In addition, the value of Δtan that has been determined based on the value of Δta1 is applied to the processing of step S113 in that flow.

As a result, the larger the rate of the amount of SOx occlusion in the upstream portion of the NOx catalyst 10, i.e., the larger the rate of the amount of SOx reduction in the upstream portion of the NOx catalyst 10, the longer the length of the rich period Δtr in rich spike processing becomes.

Here, note that in this embodiment, the distribution of the amount of SOx occlusion in the NOx catalyst 10 at that time may be estimated anew during the execution of SOx poisoning recovery processing, i.e., during the execution of rich spike control. Then, the length Δtan (n□2) of a fuel addition rich period Δta for forming a part of a second or thereafter rich period Δtr in rich spike control may be determined based on the distribution of the amount of SOx occlusion in the NOx catalyst 10 thus estimated anew. According to this, it is possible to make the length of each rich period Δtr more suitable.

Third Embodiment

Figure 5:
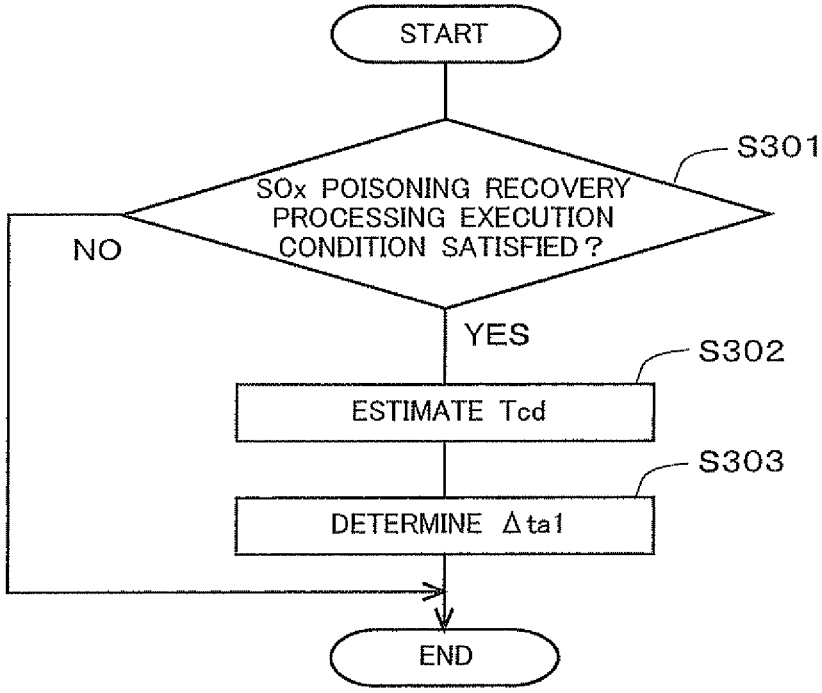
FIG. 5 is a flow chart showing the flow for determining the length of a fuel addition rich period according to a third embodiment.

Reference will be made to a third embodiment of the present invention based on FIG. 5. Here, only differences of this third embodiment from the first embodiment will be explained.

(Determination Method for Rich Period)

In this embodiment, too, SOx poisoning recovery processing is achieved by rich spike control, similar to the first embodiment. In addition, a rich period in rich spike control is formed by executing combustion rich control and fuel addition rich control in a sequential manner.

Here, at the time of executing the SOx poisoning recovery processing, the lower the temperature of the downstream portion of the NOx catalyst 10, the more the amount of SOx occluded again in the downstream portion of the NOx catalyst 10 after having once been reduced in the upstream portion thereof becomes. Accordingly, in this embodiment, the lower the temperature of the downstream portion of the NOx catalyst 10, the longer a rich period in rich spike control is made.

With this, it is possible to supply an amount of a reducing agent in accordance with the amount of SOx occluded in the downstream portion of the NOx catalyst 10 to the downstream portion thereof. As a result, the SOx reduction rate in the SOx poisoning recovery processing can be further improved.

(Flow for the Determination of Fuel Addition Rich Period)

In this embodiment, too, the above-mentioned adjustment of the length of a rich period is performed by adjusting the length of a fuel addition rich period in the rich period. Hereinafter, reference will be made to the flow for determining the length of a fuel addition rich period according to this embodiment based on a flow chart shown in FIG. 5. This flow is beforehand stored in the ECU 20, and is repeatedly carried out by the ECU 20 at a predetermined interval.

In this flow, first in step S301, it is determined whether the execution condition of SOx poisoning recovery processing has been satisfied, i.e., it is determined, in step S102 in the flow of the SOx poisoning recovery processing shown in FIG. 3, whether an affirmative determination has been made. In step S301, when an affirmative determination is made, processing in the following step S302 is carried out, whereas when a negative determination is made, the execution of this flow is once ended.

In step S302, the temperature Tcd of the downstream portion of the NOx catalyst 10 is estimated based on the output value of the downstream temperature sensor 16.

Then, in step S303, Δta1, which is the length of a fuel addition rich period Δta for forming a part of a first rich period Δtr at the time of the execution of rich spike control, is determined based on the temperature Tcd of the downstream portion of the NOx catalyst 10. Here, the lower the temperature Tcd of the downstream portion of the NOx catalyst 10, the larger the value of Δta1 is determined to be. The relation between the temperature Tcd of the downstream portion of the NOx catalyst 10 and Δta1 is beforehand determined based on experiments, etc., and is beforehand stored in the ECU 20.

The value of Δta1 that has been determined in the above-mentioned step S303 is applied to the processing of step S103 in the flow of the SOx poisoning recovery processing shown in FIG. 3. In addition, the value of Δtan that has been determined based on the value of Δta1 is applied to the processing of step S113 in that flow.

As a result, the lower the temperature Tcd of the downstream portion of the NOx catalyst 10, the longer the length of a rich period Δtr in rich spike processing becomes.

Here, note that in this embodiment, the temperature Tcd of the downstream portion of the NOx catalyst 10 at that time may be estimated anew during the execution of SOx poisoning recovery processing, i.e., during the execution of rich spike control. Then, the length Δtan (n□2) of a fuel addition rich period Δta for forming a part of a second or thereafter rich period Δtr in rich spike control may be determined based on the temperature Tcd of the downstream portion of the NOx catalyst 10 thus estimated anew. According to this, it is possible to make the length of each rich period Δtr more suitable.

Fourth Embodiment

Reference will be made to a fourth embodiment of the present invention based on FIG. 5. Here, only differences of this fourth embodiment from the first embodiment will be explained.

In this embodiment, too, SOx poisoning recovery processing is achieved by rich spike control, similar to the first embodiment. Here, during the combustion rich period Δtc in the execution of rich spike control, the temperature Tge of the exhaust gas discharged from the internal combustion engine 1 (the temperature of the exhaust gas flowing into the turbine 8*b*) rises, as stated above. When the temperature Tge of the exhaust gas rises excessively, there is a possibility of having an adverse effect on the turbine 8*b*, etc.

As a consequence, in this embodiment, the temperature Tge of the exhaust gas discharged from the internal combustion engine 1 in a combustion rich period Δtc is estimated. Then, in cases where the temperature Tge of the exhaust gas becomes higher than a predetermined upper limit exhaust gas temperature Tge1, the execution of the combustion rich control is stopped, and switching is made to fuel addition rich control.

Here, note that in this case, the combustion rich control is switched to the fuel addition rich control before the length of the combustion rich period Δtc reaches Δtan that has been set in step S103 or step S113 in the flow chart shown in FIG. 3. However, even in such a case, the length of the fuel addition rich period Δta is adjusted in such a manner that the same length of the rich period Δtr as in the case where switching is made from the combustion rich control to the fuel addition rich control after the length of the combustion rich period Δtc reaches Δtan.

According to the above, it is possible to suppress an excessive rise of the exhaust gas temperature Tge during the execution of rich spike control with higher probability.

Figure 6:
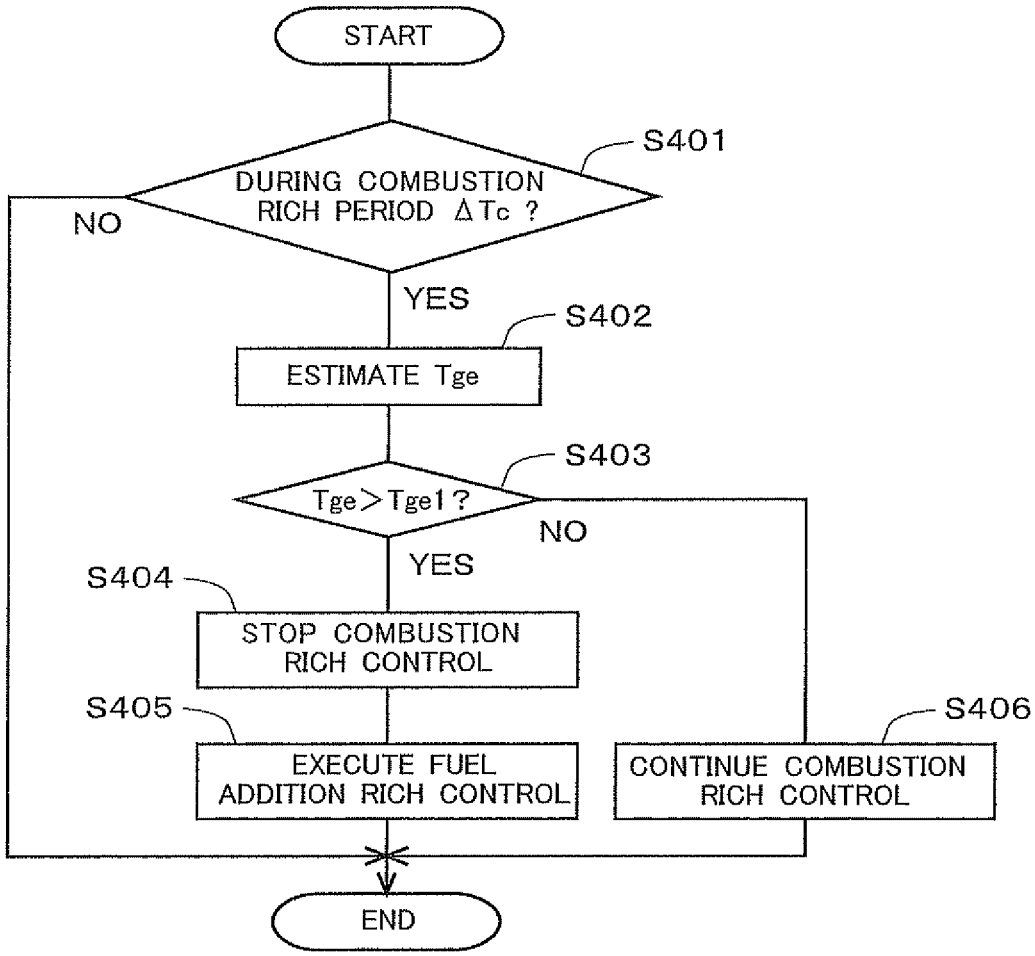
FIG. 6 is a flow chart showing the flow for suppressing an excessive rise in temperature of an exhaust gas according to a fourth embodiment.

Hereinafter, reference will be made to the flow for suppressing an excessive rise in temperature of the exhaust gas according to this embodiment based on a flow chart shown in FIG. 6. This flow is beforehand stored in the ECU 20, and is repeatedly carried out by the ECU 20 at a predetermined interval during the execution of rich spike control.

In this flow, first in step S401, it is determined whether it is during a combustion rich period Δtc. In step S401, when an affirmative determination is made, processing in the following step S402 is carried out, whereas when a negative determination is made, the execution of this flow is once ended.

In step S402, the temperature Tge of the exhaust gas discharged from the internal combustion engine 1 is estimated based on the operating state of the internal combustion engine 1. Here, note that a temperature sensor may be arranged in the exhaust manifold 7 or in the exhaust passage 6 at the upstream side of the turbine 8*b*, so that the temperature Tge of the exhaust gas may be detected by the temperature sensor.

Then, in step S403, it is determined whether the temperature Tge of the exhaust gas discharged from the internal combustion engine 1 is higher than the upper limit exhaust gas temperature Tge1. In step S403, when an affirmative determination is made, processing in the following step S404 is carried out, whereas when a negative determination is made, the processing of step S406 is then carried out.

In step S404, the execution of combustion rich control is stopped. Then, in step S405, the execution of fuel addition rich control is started.

On the other hand, in step S406, the execution of the combustion rich control is continued.

(Modification)

Next, reference will be made to a modification of this embodiment. In the combustion rich period Δtc during the execution of rich spike control, the oxidation reaction in the NOx catalyst 10 is suppressed as stated above, so the temperature Tc of the NOx catalyst 10 falls. When the temperature Tc of the NOx catalyst 10 falls excessively, there is a possibility that the reduction of SOx may become difficult.

Accordingly, in this embodiment, the temperature Tc of the NOx catalyst is estimated in the combustion rich period Δtc. Then, in cases where the temperature Tc of the NOx catalyst becomes lower than a predetermined lower limit catalyst temperature Tc1, the execution of the combustion rich control is stopped, and switching is made to fuel addition rich control.

Here, note that in this case, too, the combustion rich control is switched to the fuel addition rich control before the length of the combustion rich period Δtc reaches Δtan that has been set in step S103 or step S113 in the flow chart shown in FIG. 3. Thus, the length of the fuel addition rich period Δta is adjusted in such a manner that the same length of the rich period Δtr as in the case where switching is made from the combustion rich control to the fuel addition rich control after the length of the combustion rich period Δtc reaches Δtan.

According to the above, it is possible to suppress an excessive fall of the temperature Tc of the NOx catalyst 10 during the execution of rich spike control with higher probability.

Figure 7:
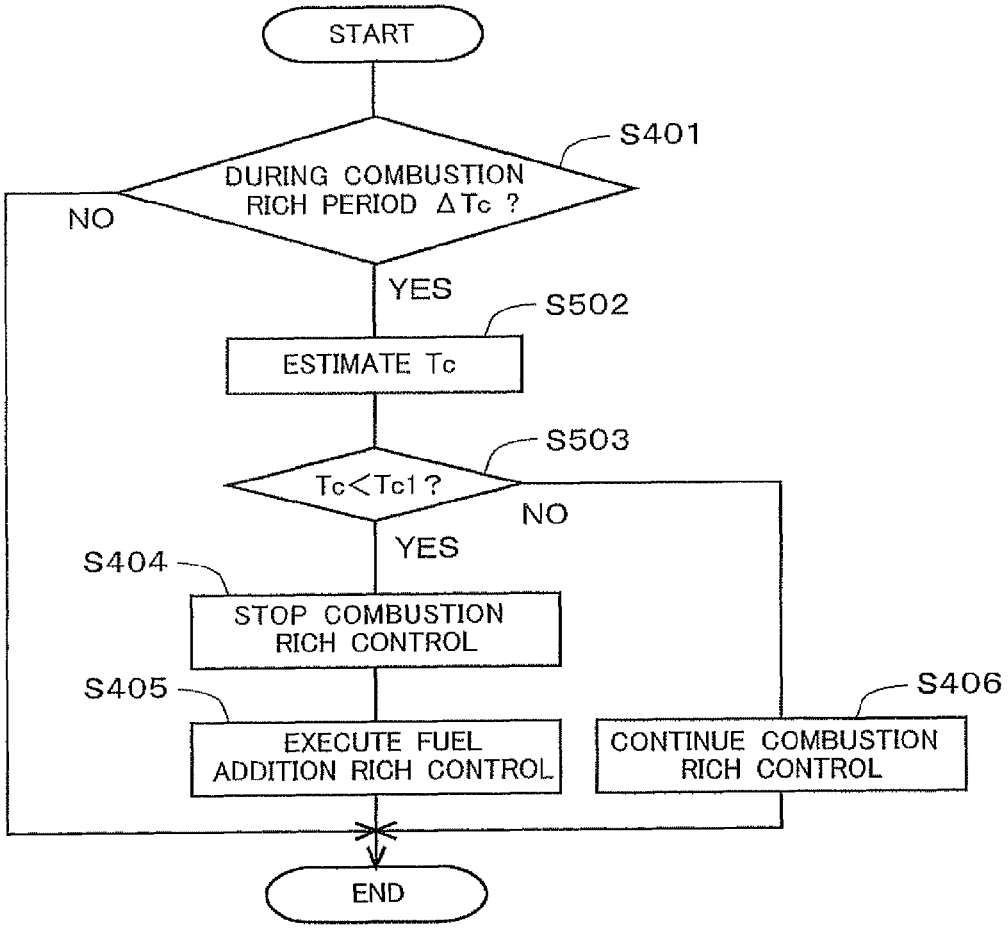
FIG. 7 is a flowchart showing the flow for suppressing an excessive fall in temperature of a NOx catalyst according to a modified form of the fourth embodiment.

Hereinafter, reference will be made to the flow for suppressing an excessive fall in temperature of the NOx catalyst according to this embodiment based on a flow chart shown in FIG. 7. This flow is beforehand stored in the ECU 20, and is repeatedly carried out by the ECU 20 at a predetermined interval during the execution of rich spike control. Here note that this flow is such that the steps S402 and S403 in the flow chart shown in FIG. 6 are replaced by steps S502 and S503, respectively. Therefore, only processing in steps S502 and S503 will be explained.

In step 502, the temperature Tc of the NOx catalyst 10 is estimated based on the output values of the upstream and downstream temperature sensors 15, 16.

Then, in step 503, it is determined whether the temperature Tc of the NOx catalyst 10 is lower than the lower limit catalyst temperature Tc1. In step S503, when an affirmative determination is made, processing in the following step S404 is carried out, whereas when a negative determination is made, the processing of step S406 is then carried out.

The above-mentioned respective embodiments can be combined as much as possible.

The invention claimed is:

1. An exhaust gas purification system for an internal combustion engine comprising:

an NOx storage reduction catalyst arranged in an exhaust passage of the internal combustion engine;

a SOx poisoning recovery processing execution unit that executes SOx poisoning recovery processing to reduce SOx occluded in the NOx storage reduction catalyst by decreasing the air fuel ratio of an exhaust gas flowing into the NOx storage reduction catalyst up to a predetermined air fuel ratio in a repeated manner, the length of an air fuel ratio decreasing period that is a period in which the air fuel ratio of the exhaust gas flowing into said NOx storage reduction catalyst is adjusted to said predetermined air fuel ratio in SOx poisoning recovery processing being made longer in a relatively early time during the execution of said processing than in a relatively late time during the execution of said processing;

a SOx reduction amount distribution estimation unit that estimates a distribution of an amount of SOx reduction in said NOx storage reduction catalyst at the time of the execution of SOx poisoning recovery processing, wherein at the time of the execution of SOx poisoning recovery processing, the larger the rate of the amount of SOx reduction in an upstream portion of said NOx storage reduction catalyst estimated by said SOx reduction amount distribution estimation unit, the longer said air fuel ratio decreasing period is made; and a SOx occlusion amount distribution estimation unit that estimates a distribution of an amount of SOx occlusion in said NOx storage reduction catalyst;

wherein said SOx reduction amount distribution estimation unit estimates the distribution of the amount of SOx reduction based at least on the distribution of the amount of SOx occlusion estimated by said SOx occlusion amount distribution estimation unit; and wherein said SOx occlusion amount distribution estimation unit estimates the distribution of the amount of SOx occlusion based at least on the history of a temperature distribution of said NOx storage reduction catalyst and the history of a flow rate of the exhaust gas flowing into said NOx storage reduction catalyst.

* * * * *